United States Patent [19]

Davis et al.

[11] Patent Number: 4,562,610

[45] Date of Patent: Jan. 7, 1986

[54] CLEANING APPARATUS FOR BOWLING LANES

[75] Inventors: John M. Davis; David G. Jennings, both of St. Joseph, Mo.

[73] Assignee: The Kegel Company, Inc., St. Joseph, Mo.

[21] Appl. No.: 359,695

[22] Filed: Mar. 19, 1982

[51] Int. Cl.[4] ..... A63D 5/10; A47L 13/24

[52] U.S. Cl. ..... 15/228; 15/99; 15/231

[58] Field of Search ..... 15/98, 99, 228, 231, 15/232, 233; 118/257

[56] References Cited

U.S. PATENT DOCUMENTS

| | | | |
|---|---|---|---|
| 1,995,685 | 3/1935 | Perkins | 15/98 |
| 2,394,585 | 2/1946 | Bailey | 15/98 X |
| 2,601,537 | 6/1952 | Lofgren | 15/231 |
| 2,690,582 | 10/1954 | Sundell | 15/228 |
| 2,828,501 | 4/1958 | Brown | 15/99 X |
| 3,116,504 | 1/1964 | Unterbrink et al. | 15/231 |
| 3,377,640 | 4/1968 | Rudolph | 15/99 |
| 4,121,315 | 10/1978 | Buser | 15/228 |

*Primary Examiner*—Edward L. Roberts

*Attorney, Agent, or Firm*—Schmidt, Johnson, Hovey & Williams

[57] ABSTRACT

The frame of the apparatus carries a pair of front and rear rollers extending across the normal path of travel of the frame during use, and a soft web of absorbent material such as terry cloth has its opposite ends coiled around the two rollers and a mid-portion thereof looped beneath a transverse fulcrum roller on the frame which is located between the two coil rollers. Inasmuch as the fulcrum roller is disposed with its lower lane-engaging periphery out of alignment with the peripheries of the other two rollers, the terry cloth web bears against the surface only at two spaced locations, i.e., either the fulcrum and the forward roller or the fulcrum and the rear roller. When the frame is advanced forwardly down the lane, the frame is rocked forwardly about the fulcrum roller such that the forward coil roller swings down into engagement with the lane surface to serve as a means for scrubbing and lifting deleterious materials from the lane surface after a cleaning liquid, such as warm water, has been distributed across the front of the frame. When the frame is then moved in the opposite direction along the lane in a return stroke, the frame rocks rearwardly about the fulcrum roller to engage the rear coil roller with the lane surface so as to absorb and break into fine droplets any accumulations of cleaning liquid which may have been left on the lane surface during the first pass.

6 Claims, 13 Drawing Figures

Fig. 11.
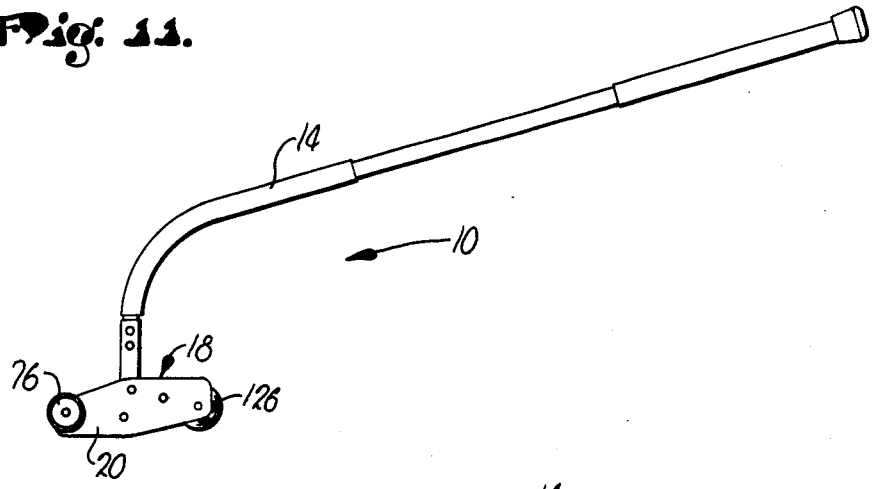
Fig. 12.
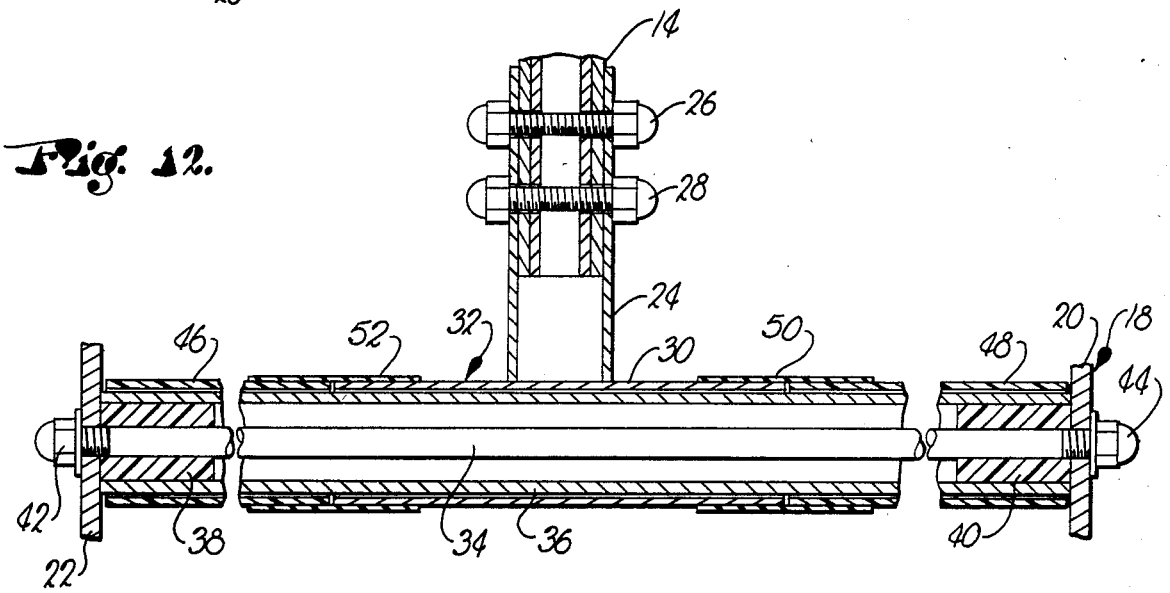
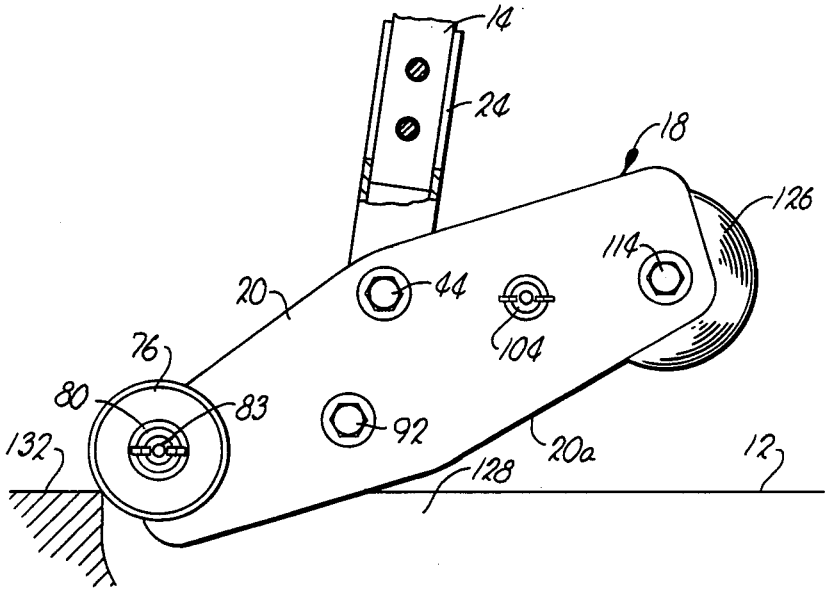
Fig. 13.

CLEANING APPARATUS FOR BOWLING LANES

TECHNICAL FIELD

This invention relates to the field of bowling lane maintenance equipment and, more particularly, to a tool by which the surface of the lane may be quickly yet reliably removed of dirt and oil in which the dirt is embedded in order to place the lane surface in proper condition for oil application.

BACKGROUND ART

While the application of oil to bowling lane surfaces is desirable in some respects in order to preserve and protect such surfaces, the manner in which it is applied, and the characteristics thereof once it is down are carefully controlled by those associations which certify bowlers' scores inasmuch as lane conditions have a dramatic effect upon behavior of the ball as it rolls along the lane surface toward the pins. It is desirable in this respect for all lanes across the country to be oiled in substantially the same manner so that scores in one "house" are reasonably consistent with scores in any other house sanctioned by the same authority.

Once optimum lane conditions have been obtained, however, they are difficult to maintain inasmuch as dirt and grime become quickly embedded in the oil and frequent abrading by the ball against the surface tends to wear away and destroy the carefully prepared treatment. Furthermore, urethane lane coatings commonly used on more modern lanes tend to create static electrical charges which attract dirt and grime, thereby exacerbating the problem.

Furthermore, present techniques for removing the grimy and uneven oil films are time consuming and inefficient, requiring in many cases that the cleaning person get on his hands and knees using a pail, a scrub brush and a towel for mopping up.

Still further, current techniques include the use of solvent base cleaners and detergents that frequently leave residues which impair proper ball action and contribute to the imprecise lane conditions which are sought to be avoided.

SUMMARY OF THE PRESENT INVENTION

Accordingly, one important object of the present invention is to provide a lane cleaning apparatus which is dramatically effective in picking up dirt and grimy oil films from lane surfaces yet is simple and easy to use by less than highly skilled personnel in an amount of elapsed time that is only fractions of that heretofore required. Thus, the present invention is intended to promote the standardization of lane conditions by encouraging frequent cleaning and stripping of harmful, grimy films from the lane surfaces.

Pursuant to the foregoing, the present invention includes an apparatus which may be embodied in a manually operated hand tool that may be pushed or pulled along a lane surface by a long handle pivotally connected to the frame of the tool. The frame rocks forwardly when the tool is pushed along the lane surface so as to engage one face of a soft terry cloth web of material or the like with the surface of the lane at a forwardmost location where the web is coiled about a front take-up roller. A fulcrum roller near the middle of the tool has the web looped beneath the same so as to present an opposite face of the web to the lane surface for engagement simultaneously with engagement of the front take-up coil. A cleaning solution may be applied to the lane immediately ahead of the tool for scrubbing and dislodging the grimy film with the front take-up roller and then lifting it off the surface with that portion of the web looped beneath the fulcrum roller. As the tool is then pulled back down the lane, it rocks rearwardly about the fulcrum roller to bring a rear roller from which the web is dispensed into engagement with the lane surface. Such contact by the rear roller and the fresh, dry web of material picks up and disperses any droplets of liquid which may remain on the surface after the first pass down the lane so as to effectively dry and remove moisture from the lane surface. The web is coiled about the front and rear rollers and the intermediate fulcrum roller in such a manner that a different face of the web is presented to the lane surface by the fulcrum roller than is presented by the front and rear coil rollers. Thus, although one face of the web may have previously become dampened during its use on the rear roller for drying purposes, the opposite face thereof is used against the lane surface at the fulcrum roller where pick-up of the dislodged grit and grimy oil occurs. The grimy face of the web at the fulcrum roller then becomes the inside face of the coil at the scrubbing roller at the front of the tool so that a clean surface is presented for scrubbing and cleaning at that location.

BRIEF DESCRIPTION OF THE DRAWINGS

FIG. 11 is a left side elevational view of the apparatus on a reduced scale;

FIG. 12 is an enlarged vertical cross-sectional view through the apparatus adjacent the point at which the handle thereof is connected to the frame; and FIG. 13 is a fragmentary left side elevational view of the apparatus illustrating the manner in which the freely rotating wheels at the front end of the apparatus assist in lifting the unit out of the gutter as it approaches the foul line during use.

DETAILED DESCRIPTION

Figure 1:
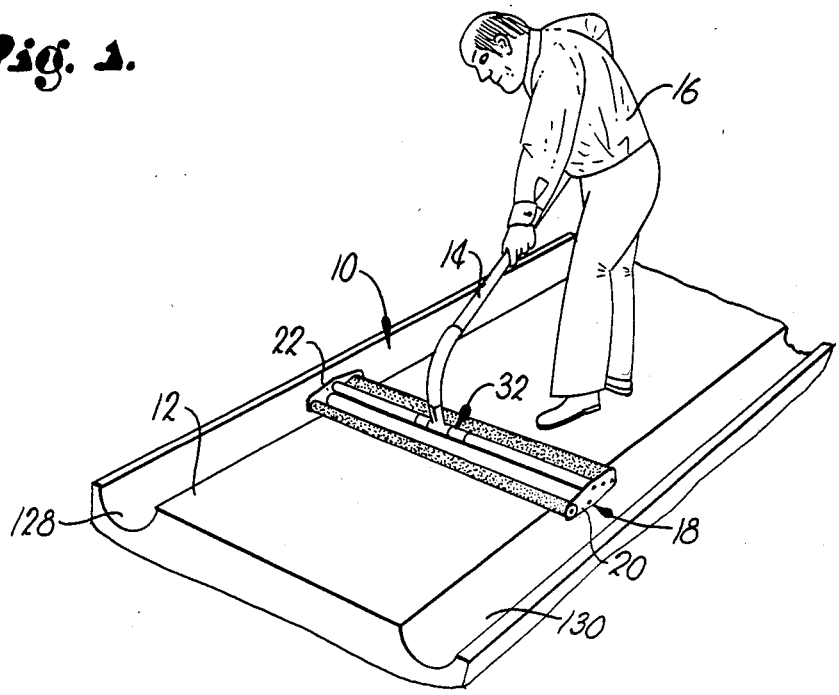
FIG. 1 is a front, left perspective view of cleaning apparatus embodying the principles of the present invention shown in use.
Figure 2:
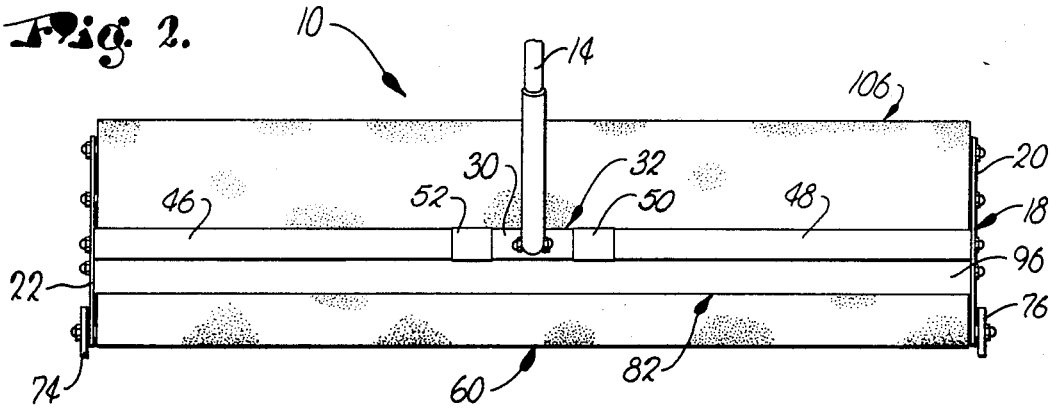
FIG. 2 is a fragmentary, enlarged, top plan view thereof.
Figure 3:
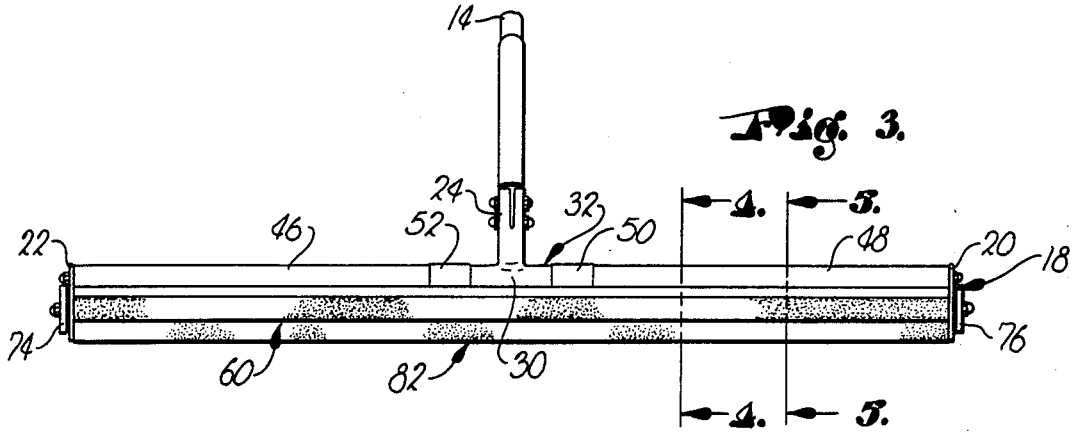
FIG. 3 is a fragmentary front elevational view thereof.

As shown in FIG. 1 the apparatus 10 is designed for use in connection with a bowling lane 12 and is illustrated by way of example as embodied in the form of a manually operated tool, although it will be appreciated from the description which follows that the principles of the apparatus may also be embodied in an electrically powered self-propelled unit, for example. In the manually operated form, the apparatus includes a long handle 14 which is grasped by the user 16 for operating purposes. The handle 14 has a down-turned, forwardmost end that is pivotally connected to the frame 18 of the apparatus for pushing and pulling the frame 18 along the lane surface 12, the pivotal arrangement permitting the handle 14 to be raised and lowered as necessary to suit the comfort and convenience of the user 16 doing operation.

Figure 6:
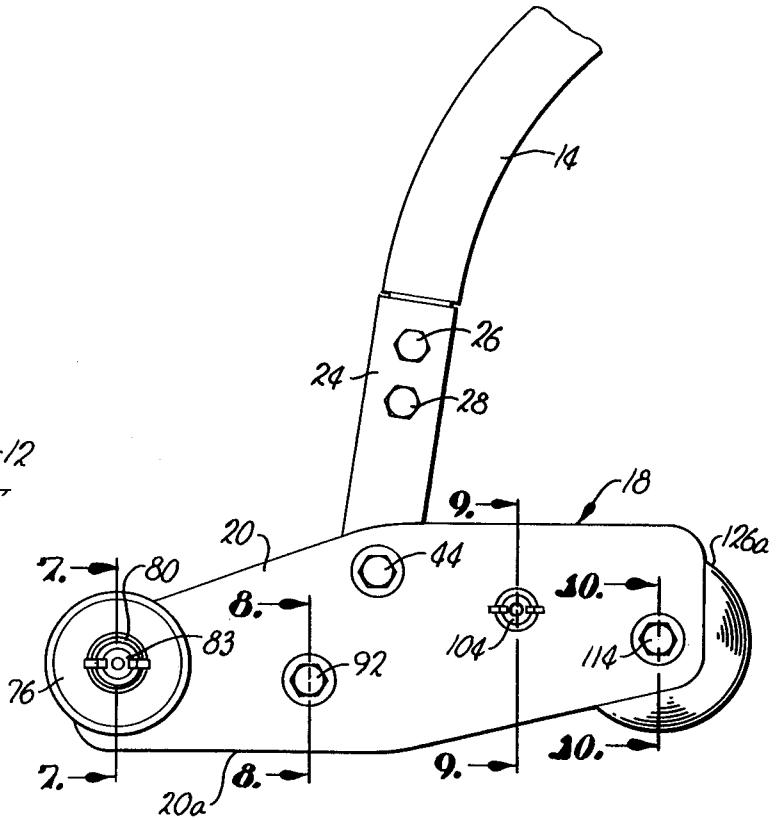
FIG. 6 is a fragmentary left side elevational view of the apparatus.
Figure 5:
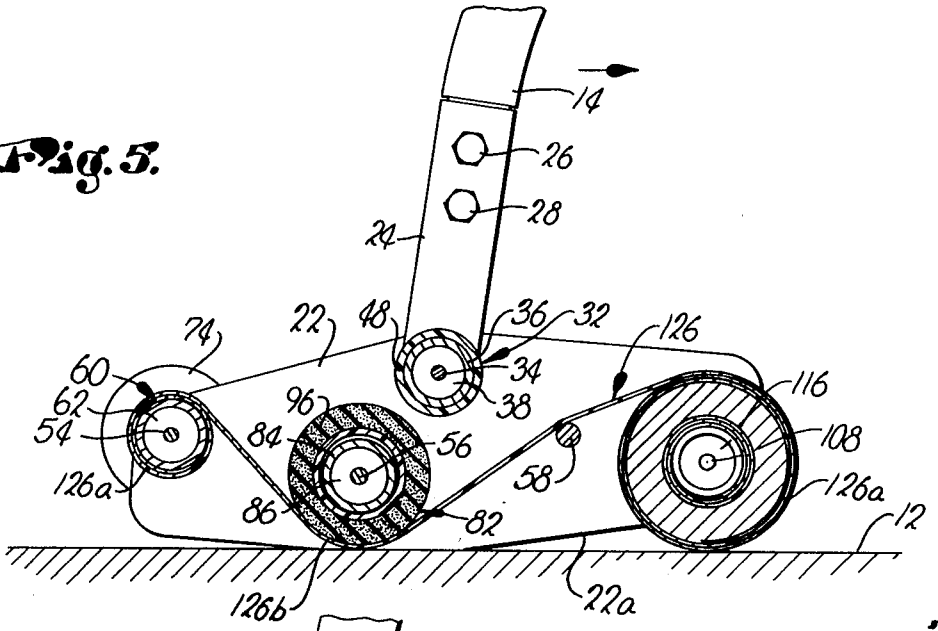
FIG. 5 is an enlarged, fragmentary, transverse cross-sectional view of the apparatus similar to FIG. 4 but showing the way in which the frame rocks back to lift the front roller out of engagement with the lane surface and instead place the rear drying roller thereof in engagement as the apparatus is pulled back along the lane surface in a drying stroke.
Figure 4:
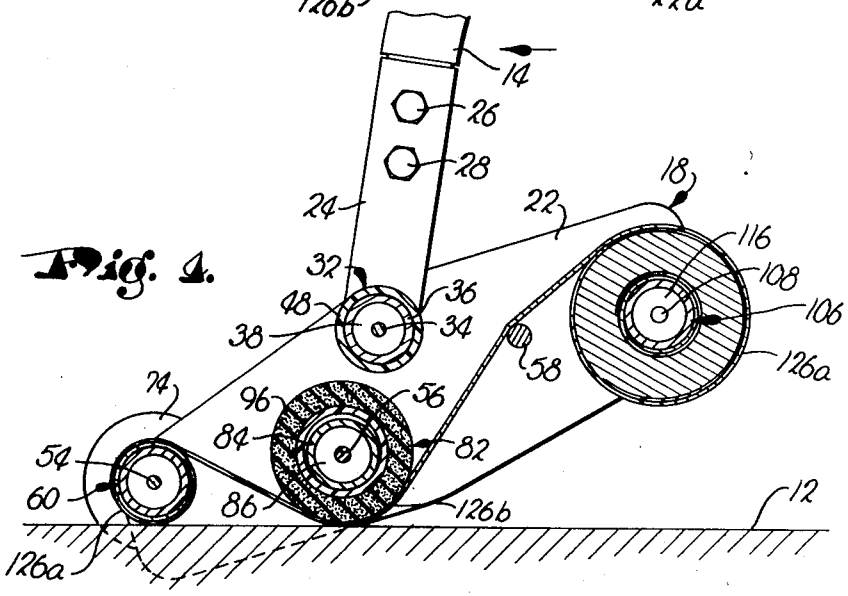
FIG. 4 is an enlarged, fragmentary transverse cross-sectional view through the apparatus taken substantially along line 4—4 of FIG. 3 and showing the manner in which the frame is tipped forwardly as the tool is pushed down the lane surface during the cleaning stroke.

The frame 18 includes a pair of laterally spaced apart side plates 20 and 22 respectively which are somewhat diamond shaped as illustrated perhaps most clearly in FIGS. 4, 5 and 6 for example. As shown in FIG. 12, the handle 14 is telescopically received within a mating socket 24 and is detachably held in that condition by a pair of suitable fasteners 26 and 28, the lower end of the socket 24 being fixed to a transversely extending tube 30 forming a part of the pivotal coupling 32 by which the handle 14 is connected to the frame 18. Such coupling 32 additionally includes a transverse rod 34 spanning the plates 20 and 22, a cylinder 36 likewise spanning the plates 20, 22 and receiving the rod 34 in concentric relationship through the medium of a pair of plugs 38 and 40 pressed into opposite ends of the cylinder 36, and nuts 42 and 44 threaded onto opposite ends of the rod 34 at their points of projection through the plates 20 and 22. By tightening down the nuts 42, 44, the plates 20, 22 are drawn tightly against the cylinder 36 which becomes a bearing member for the tube 30 that is rotatably received thereon. Further included in the coupling 32 is a pair of sleeves 46 and 48, each of which is received upon the cylinder 36 at opposite ends of the tube 30 to maintain the latter centered between the side plates 20, 22 and to provide a shielding or shroud for the cylinder 36 which may advantageously be covered with grease or the like to facilitate rotation of the tube 30 about the cylinder 36 when the handle 14 is swingably raised and lowered by the user. Also of assistance in this regard is a pair of elastomeric, tubular seals 50 and 52 which overlap the interface between the tube 30 and sleeves 46, 48 to prevent the escape of lubricant at those locations.

Figure 7:
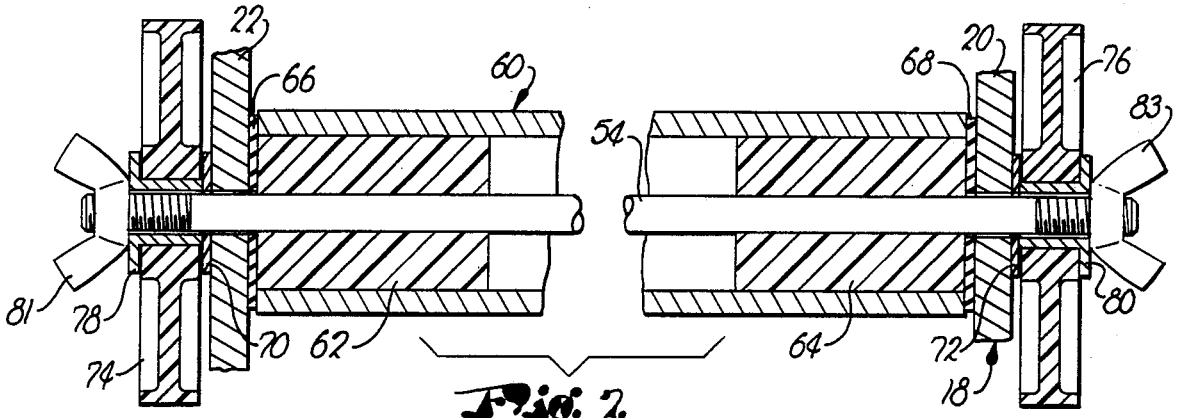
FIG. 7 is an enlarged, fragmentary vertical cross-sectional view through the apparatus taken substantially along line 7—7 of FIG. 6.
Figure 8:
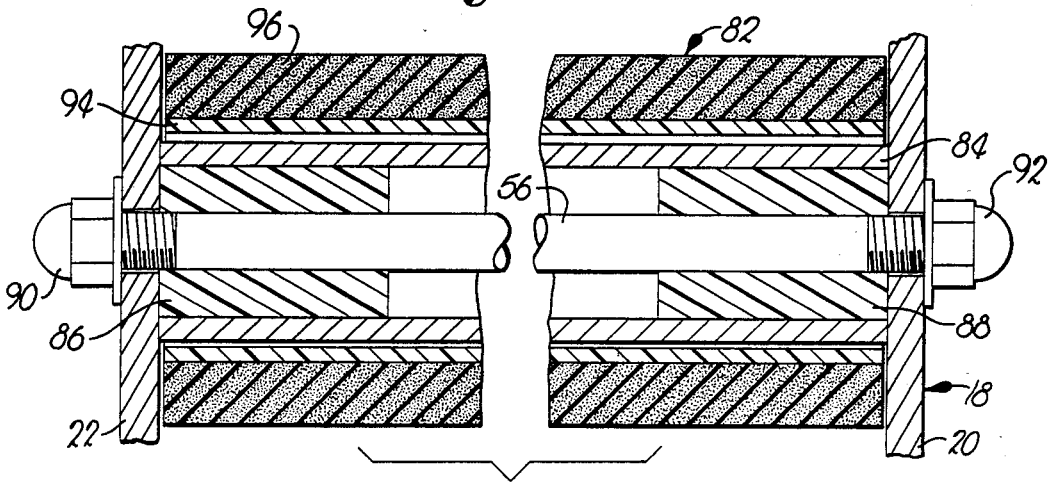
FIG. 8 is an enlarged, fragmentary vertical cross-sectional view through the apparatus taken substantially along line 8—8 of FIG. 6.
Figure 9:
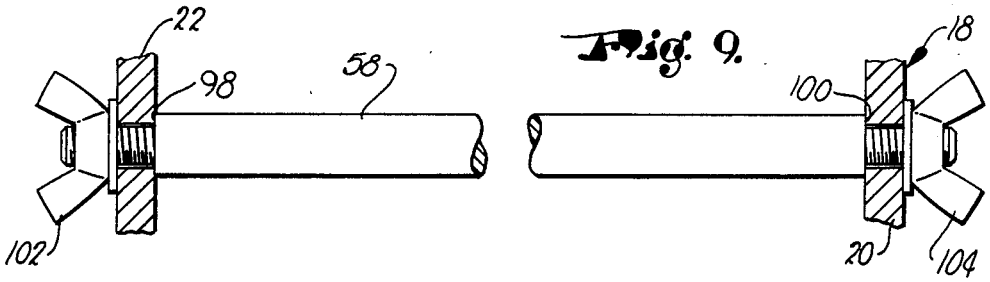
FIG. 9 is an enlarged, fragmentary vertical cross-sectional view through the apparatus taken substantially along line 9—9 of FIG. 6.

In addition to the side plates 20, 22, the frame 18 also includes a series of transverse rods that span the plates 20, 22 and maintain the same in spaced apart relationship, such rods including not only the rod 34 associated with coupling 32, but also rods 54, 56 and 58 shown, for example, in FIGS. 7, 8 and 9. The rod 54 is positioned at the upper front extremity of the frame 18 and carries a front roller 60 by virtue of a pair of mounting plugs 62 and 64 pressed into opposite ends of the roller 60. A pair of leather disks 66 and 68 are clamped between the opposite ends of the roller 60 and the proximal surfaces of the corresponding side plates 22 and 20 so as to frictionally prevent free rotation of the roller 60 and yet permit such rotation upon the application of a sufficient manually or mechanically applied rotative force. The rod 54 passes entirely through the side plates 20 and 22 and has a pair of washers 70 and 72 immediately outboard of the plates 20, 22 which are disposed between the latter and a pair of freely rotatable wheels 74 and 76 rendered rotatable relative to the rod 54 by bushings 78 and 80. Wing nuts 81 and 83 on the opposite threaded ends of the rod 54 adjustably clamp the entire assembly together at the forward end of the frame 18 and control the amount of friction drag imparted by the leather disks 66 and 68 to the roller 60. As illustrated, the roller 60 has a hard metal periphery.

The rod 56 also carries a roller, such roller being broadly denoted by the numeral 82 and, as will hereinafter be made apparent, the roller 82 serves as a fulcrum for the fore-and-aft rocking action which may be imparted to the frame 18. The fulcrum roller 82 is disposed rearwardly of the front roller 60 and slightly lower than the latter at such a point that its lowermost extremity is only a short distance above the lowermost edges 20*a* and 22*a* of the side plates 20, 22. As illustrated in particular detail in FIG. 8, the fulcrum roller 82 includes an internal cylinder 84 attached to the rod 56 via plugs 86 and 88 at opposite ends thereof and clamped immovably between the plates 20 and 22 by nuts 90 and 92 on the threaded opposite ends of the rod 56. Further comprising a part of the fulcrum roller 82 is a tube 94 rotatable on the immovable cylinder 84 and extending substantially the full width of the frame 18, and a soft, resilient peripheral jacket 96 of foam rubber or the like which encircles the tube 94, extends substantially the full length thereof, and is rotatable with the same about the axis defined by the rod 56.

As shown in FIG. 9, the rod 58 has no roller associated therewith and serves only as a means for lending structural rigidity to the frame 18. In this regard, the rod 58 has a pair of opposite end shoulders 98 and 100 which bear against the corresponding side plates 22 and 20 on the inboard faces thereof. Wing nuts 102 and 104 are threaded onto respective outer ends of the rod 58 whereby to bear against the outer respective faces of the plates 22 and 20 when nuts 102, 104 are tightened down.

Figure 10:
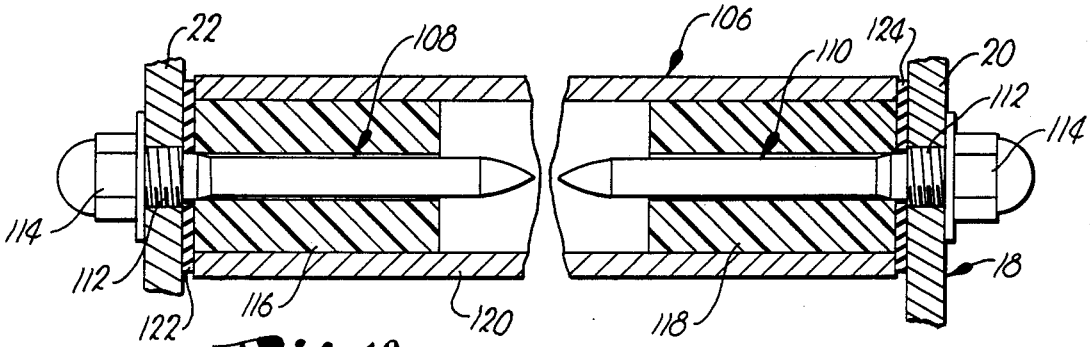
FIG. 10 is an enlarged, fragmentary vertical cross-sectional view through the apparatus taken substantially along line 10—10 of FIG. 6.

A rear roller 106 shown in detail in FIG. 10, for example, is rotatably carried by a pair of axially aligned spindles 108 and 110 projecting inwardly from opposite ones of the plates 22 and 20 respectively. Each of the spindles 108, 110 has a threaded shank portion 112 which is threadably received within the corresponding plate 22 or 20 to the extent permitted by an outermost head 114 which comes to bear against the outboard face of the corresponding plate 22 or 20. The spindles 108 and 110 in turn rotatably carry a pair of plugs 116 and 118 respectively which are pressed into opposite ends of the hard metal tube 120 forming the most dominant and visible portion of the roller 106 and extending the full width of the frame 18. A pair of leather friction disks 122 and 124 are carried by the spindles 108 and 110 respectively in clamping relationship between opposite ends of the tube 120 and the side plates 22, 20 whereby to prevent free rotation of the roller 106. On the other hand, the roller 106 may be mechanically or manually rotated when the resistance generated by the leather disks 122 and 124 has been overcome.

The apparatus 10 further includes a web of soft, absorbent material such as terry cloth, such web being denoted by the numeral 126. As illustrated in FIGS. 4 and 5, the web 126 is stretched between the front roller 60 and the rear roller 106 and is looped beneath the fulcrum roller 82, the web 126 also passing over and in engagement with the transverse rod 58 just prior to the rear roller 106. As also illustrated, it is to be noted that the web 126 is coiled about the rollers 60 and 106 in opposite directions, i.e., up and over the roller 60 in a counterclockwise direction viewing FIGS. 4 and 5 and up and over the roller 106 in a clockwise direction viewing FIGS. 4 and 5. Consequently, one face 126*a* of the web 126 is exposed on the rollers 60 and 106 while the opposite face 126*b* is exposed at the fulcrum roller 82. To be further noted is the fact that the periphery of the fulcrum roller 82 is disposed in offset relationship to an imaginary straight line intersecting the lower peripheries of the rollers 60 and 106 such that all three of the rollers 60, 82 and 106 cannot engage the lane surface 12 at the same time.

OPERATION

As illustrated in FIG. 1, the side plates 20 and 22 are spaced apart by a distance that enables the frame 18 to completely span the surface of the lane 12 with the plates 20, 22 disposed within the gutters 128 and 130 on opposite lateral sides of the lane surface. Thus, even though a part of the lowermost edges 20*a* and 22*a* of the side plates 20 and 22 projects downwardly below the corresponding periphery of the fulcrum roller 82, such parts do not support the fulcrum roller 82 above the lane surface 12 but rather permit the same to directly bear against the surface.

As the apparatus 10 is prepared for use, the frame 18 is placed upon the lane 12 in the manner above-described, and a suitable cleaning solution, such as hot water, is poured evenly across the lane 12 immediately in front of the front roller 60. Thereupon, the user 16 pushes forwardly and downwardly with the handle 14 so as to generate a counterclockwise moment on the frame 18 about the fulcrum roller 82 as viewed in FIG. 4. Such moment is due to the fact that the point of application of the pushing force to the frame 18 via the handle 14 is spaced above the fulcrum roller 82. Therefore, the frame 18 rocks forwardly about the fulcrum roller 82 as shown in FIG. 4 to bring the roller 60 down to bear against the lane 12 in addition to the fulcrum roller 82. Actually, the face 126*a* of web 26 and the opposite face 126*b* thereof are simultaneously brought to bear against the lane surface 12 at the fulcrum roller 82 and the front roller 60 as the user commences pushing the frame 18 along the lane 12. As the front roller 60 bears against the lane surface 12, the raised nap of the terry cloth web 126 cooperates with the warm water or other cleaning solution to effect a scrubbing action across the entire lane width which dislodges and loosens grit, oil and grime from the lane. The immediately trailing fulcrum roller 82, acting through the opposite face 126*b* of the web 126 serves to then pick up the loosened substances as it passes over the spot which has been worked on by the front roller 60. Such action continues as the user moves on down the lane, preferably from the pins toward the foul line, until reaching the foul line, at which point the wheels 74 and 76 strike the end of the gutters (128*a* for example as shown in FIG. 13), whereupon the wheels 74 and 76 help the side plates 20 and 22 rise up out of the gutters 128 and 130 at that location. As will be noted, the axis of rotation of the wheels 74 and 76 is disposed above the level of the approach surface 132 shown in FIG. 13 whereby proper action of the wheels 74 and 76 is assured as the end of the gutters is reached.

Once the first scrubbing stroke has been completed, the user may pause momentarily and turn the front roller 60 in a counterclockwise direction viewing FIG. 5 for a short distance so as to uncoil a new portion of the web 26 from the rear roller 106 and to coil up the dirty portion of web face 126*a* on front roller 60 to place it out of position for engagement with the lane surface. This will also have the effect of displacing a used portion of the web face 126*b* that has been underneath the fulcrum roller 82 toward the front roller 60.

The user then simply pulls the frame 18 back down the alley 12 via the handle 14, and as such pulling action commences, the frame 18 rocks in a clockwise direction viewing FIG. 5 about the fulcrum roller 82 so as to bring the rear roller 106 to bear against the lane 12. Thus, that lowermost portion of the web coil about the rear roller 106 is brought into wiping engagement with the lane 12, simultaneously with that portion of the web 26 looped under the fulcrum roller 82. Hence, the web 126 is wiped along the lane 12 in a drying stroke to pick up and disperse water droplets that may have been left on the lane during the initial scrubbing stroke.

It has been found that in most instances one complete cycle up and down a lane through a scrubbing and drying stroke is fully sufficient to remove the deleterious grit, grime and oil from the lane 12. It is also to be noted that because of the way in which the web 126 is presented to and coiled around the rollers 60, 82 and 106, those portions of the web 126 which are devoted to picking up water or grimy materials are used only once in such pick-up functions. Note for example that the face 126*a* of the web 126 is initially used to pick up water droplets or the like at the rear roller 106 as the frame 18 is pulled down the lane in a drying stroke. Thereupon, as such portion of the web 126 ultimately becomes drawn forwardly toward the front roller 60 as the latter winds up the web 126, the face 126*a* is not exposed to the lane 12 as the web 126 passes beneath the fulcrum roller 82. Thus, although a pick-up action is occurring at that point beneath the fulcrum roller 82, such is being carried out by the opposite face 126*b* of the web 126. Then, as the portion of the web face 126*a* is wrapped on around the front roller 60 and ultimately comes to the lower periphery thereof, it is only then used in a scrubbing action to dislodge, rather than pick up and retain, the grimy materials as they are encountered by the advancing frame 18 in the cleaning stroke. Moreover, it is to be noted that the pick-up portion of the web 126 directly beneath the fulcrum roller 82 on the face 126*b* thereof is used only once because it has been on the inside of the web coil around the rear roller 106 during a drying pass and then resumes its position on the inside of the web coil around the front roller 60 on a scrubbing pass.

As earlier noted, the principles of the present invention need not be embodied in a manually operated tool, but may instead be in a self-propelled device or the like which would not have a handle 14. Notwithstanding the absence of the handle 14, however, the frame 18 would still be operable to rock about the fulcrum roller 82 in the above-described manner, whereby to permit the effective, quick and thorough stripping of oil and harmful materials from the lane surface in but a single pass up and down the lane.

We claim:

1. Apparatus for use in cleaning bowling lanes and the like comprising:

a rockable frame;

a pair of transversely extending rollers carried by said frame in laterally spaced apart relationship;

a web of absorbent material stretched between said rollers and coiled around the same in such a manner that as one of the rollers is rotated to coil up the web, the other roller pays out the web to the one roller;

means for releasably retaining the rollers in selected rotative positions;

a web-engaging fulcrum carried by said frame between said rollers in offset relationship with an imaginary line intersecting the peripheries of the web coils around said rollers whereby the frame may be rocked fore-and-aft about said fulcrum to selectively bring either of said web coils and the fulcrum-engaged portion of the web to bear against the lane surface; and means for rocking the frame about said fulcrum in one direction when the frame is moved forwardly along the lane surface and for rocking the frame in the opposite direction about the fulcrum when the frame is moved reversely along the lane surface, at least one fore-and-aft extremity of said frame being provided with a pair of laterally spaced apart, freely rotatable wheels positioned outboard of opposite lateral extremities of the frame and projecting forwardly therefrom above lowermost extremities of said rollers for facilitating the clearance of obstacles by the frame in alignment with said wheels.

2. Apparatus as claimed in claim 1, wherein said web is looped under said fulcrum and thence over and around said rollers whereby to be coiled about the rollers in mutually opposite directions so as to present one face of the web to the lane surface at said fulcrum and the opposite face of the web to the lane surface at said rollers.

3. Apparatus as claimed in claim 1, wherein said frame includes a pair of laterally spaced sideplates disposed to be positioned outboard of the respective lateral extremities of the lane surface during use, said sideplates each having a normally lower edge at least a part of which projects downwardly beyond the fulcrum and the fulcrum-engaged portion of the web.

4. Apparatus as claimed in claim 1, wherein said fulcrum comprises a third roller carried by said frame in substantial parallelism to said pair of rollers.

5. Apparatus as claimed in claim 4, wherein said fulcrum roller includes a relatively soft, resilient outer periphery.

6. Apparatus as claimed in claim 5, wherein the rollers of said pair are each provided with a hard outer periphery relative to said soft periphery of the fulcrum roller.

* * * * *